United States Patent [19]

Weiss

[11] 4,308,626

[45] Jan. 5, 1982

[54] FITTED TOP SHEET

[75] Inventor: Sidney M. Weiss, Greenwich, Conn.

[73] Assignee: Sleep Knit Corporation, New York, N.Y.

[21] Appl. No.: 230,130

[22] Filed: Jan. 30, 1981

[51] Int. Cl.[3] ..... A47G 9/02

[52] U.S. Cl. ..... 5/485; 5/497

[58] Field of Search ..... 5/485, 497, 482, 495

[56] References Cited

U.S. PATENT DOCUMENTS

| | | | |
|---|---|---|---|
| 2,577,178 | 12/1951 | Bellinger . | |
| 2,603,798 | 7/1952 | Crescenzi . | |
| 2,679,056 | 5/1954 | Simpson | 5/485 |
| 3,789,441 | 2/1974 | Weiss | 5/497 |

FOREIGN PATENT DOCUMENTS 754696 8/1956 United Kingdom .

*Primary Examiner*—Alexander Grosz
*Attorney, Agent, or Firm*—Brumbaugh, Graves, Donohue & Raymond

[57] ABSTRACT

A fitted top sheet includes a construction which provides a foot accommodating space when placed in position on a mattress. The sheet has a one piece construction wherein the fitted bottom corners and foot accommodating space are formed by sewing the cut edges of two cut-outs in each side of a generally rectangular piece of material.

9 Claims, 5 Drawing Figures

FITTED TOP SHEET

BACKGROUND OF THE INVENTION

This invention relates to fitted top sheets, and in particular to fitted top sheets which have provisions for an expansion space under the sheet for the accommodation of the user's feet.

U.S. Pat. No. 2,603,789 discloses a fitted top sheet, wherein the base of the sheet is arranged to fit snugly around the base of the mattress. This arrangement is similar to the arrangements for fitted bottom sheets, such as described in my prior U.S. Pat. No. 3,789,441. While close fitting is desirable in connection with bottom sheets, a close fitting top sheet causes cramping of the users feet, which makes the sheet uncomfortable to use, and can cause substantial irritation when used by a bedridden patient.

British Pat. No. 754,696 addresses this problem by providing a retaining strap 9 which can be pulled out of its usual position in order to provide a measure of space for the user's feet. This arrangement, however, still provides an amount of stress on the user's feet caused by the need to displace the retaining strap out of its usual position.

Prior U.S. Pat. No. 2,577,178 to Bellinger discloses a fitted top sheet which has an added triangular cross-section flap which extends from the main body of the sheet to accommodate the user's feet. This separate flap substantially complicates sheet construction.

Prior U.S. Pat. No. 2,679,056 to Simpson discloses a fitted top sheet with extra material provided to form a foot accommodating space which has its maximum vertical extension at the base of the mattress. The Simpson arrangement involves a rather complex cutting and sewing construction of the sheet and requires the provision of a triangular flap 21 for aid in maintaining the sheet in position on the bed.

It is therefore an object of the present invention to provide a new and improved fitted top sheet, which has an economical construction and which is comfortable to the user.

SUMMARY OF THE INVENTION

In accordance with the invention, there is provided a fitted bedcover which is formed from a generally rectangular piece of material having a top edge, a bottom edge and two side edges. The bedcover has two fitted bottom corners, each formed by a first cut-out of the rectangular piece at the junction of one of the side edges and the bottom edge. These cut-outs are joined along their cut edge to form the fitted corners. The bedcover has a foot accommodating space when placed on a mattress. The space has a maximum mattress to cover height spaced at a distance from the bottom edge of the mattress. The space is formed by at least two tucks, one adjoining each of the material piece side edges. Each of the tucks is formed by joining opposite edges of a second, generally triangular cut-out in each side edge of the piece.

The fitted top sheet of the present invention is preferably formed out of stretch material, for example, two-way stretch knitted fabric. The second cut-out which forms the tuck is preferably formed from a pair of symmetrical first cut edge portions perpendicular to and intersecting the side edges and a pair of second cut edge portions tapered to a point. The second cut-out is preferably spaced along the side edge from the first cut-out.

The sheet may be provided with edge binding for reinforcement and may have rounded corners where the side edges join the top edge.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
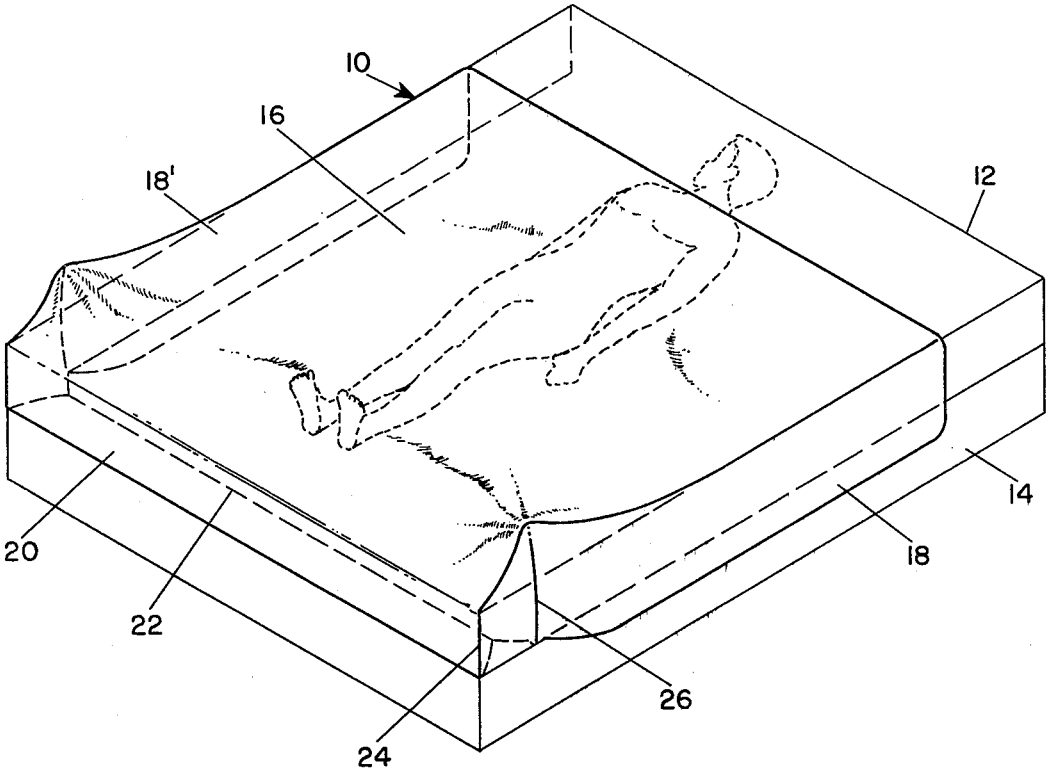
FIG. 1 is a perspective view of a bed provided with a top sheet in accordance with the present invention.
Figure 2:
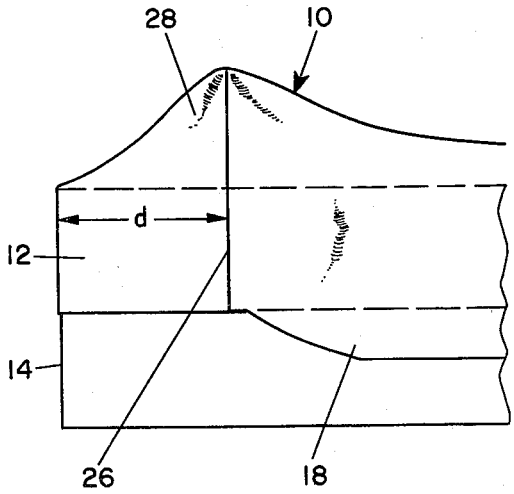
FIG. 2 is a partial side view of the bed and top sheet of FIG. 1.
Figure 3:
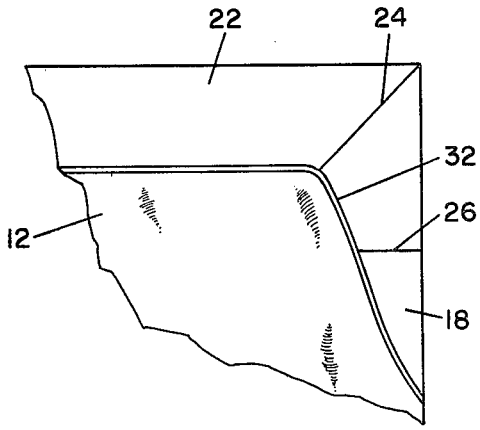
FIG. 3 is a partial view of the bottom of a mattress having the top sheet of FIG. 1.

Referring to FIGS. 1, 2 and 3, there is shown fitted top sheet 10 in accordance with the present invention as used on a mattress 12 supported by a mattress support 14. The sheet 10 has a top side 16, side portions 18, a bottom portion 20 and a flap 22 designed to be held below mattress 12. The lower portion of sheet 10 has fitted corners formed by a seam 24 which extends from the side edges of flap 22 around the mattress corner to the top 16. There is also provided an additional seam 26 extending from the portion of side 18 below mattress 12 vertically along side 18 to thereby form a tent-like foot accommodating space 28.

An important feature of the fitted top sheet of the present invention, which is especially evident from the side view of FIG. 2 is the formation of the foot accommodating space. Seam 26 is arranged so that the foot accommodating space has a maximum vertical height between the mattress and the sheet at the position of seam 26, which is spaced a distance D, preferably about 12 inches, from the fitted corner forming seam 26. This spacing of the foot accommodating space prevents cramping of the user's feet when blankets or other bedcovers are provided over the fitted top sheet and tucked under the mattress. Such use of additional bed clothes with prior art fitted top sheets such as that disclosed by Simpson or in the aforementioned British patent will prevent lifting of the sheet from the mattress to accommodate the user's feet.

Another important feature of the sheet 10 of the present invention is the simplicity of the sheet construction. It will be noted that the sheet is formed entirely out of a single piece of material, which is cut and sewn at two places along each side to form the fitted corner seam 24 and the foot accommodating space 28. Unlike prior art fitted top sheets, no attempt is made to maintain rectangular corner seams end pieces, but the fitted flap 22 joins the end of the mattress engaging portion of each side 18 and then flows smoothly into the freely hanging upper portion of each side 18, which can be lifted on and off the bed or tucked under the side according to the desires of the user.

Figure 4:
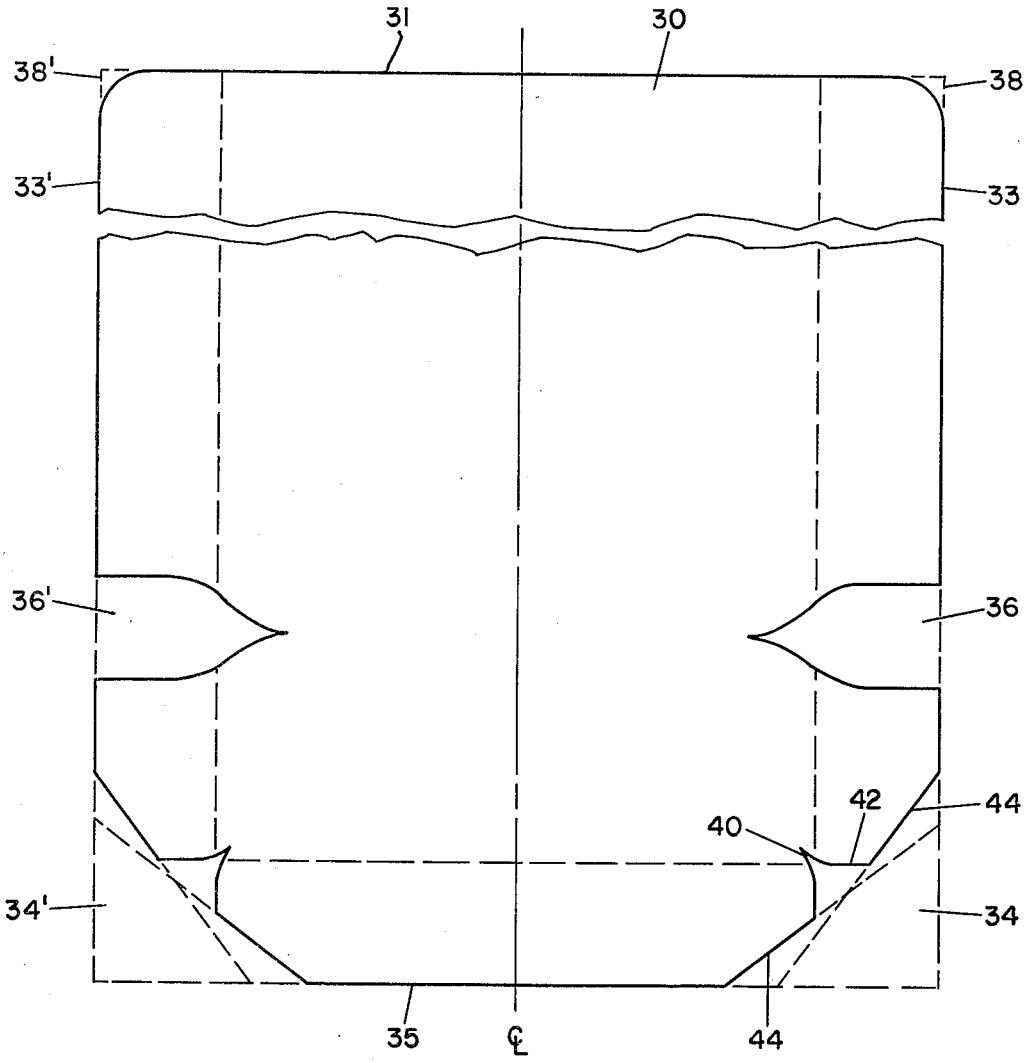
FIG. 4 is a drawing of a piece of material, from which the FIG. 1 sheet is made.

FIG. 4 is a plan view of a piece of material cut to form a blank for manufacture of the sheet 10 of FIGS. 1 to 3. In one embodiment, the rectangular blank 30 is approximately 57 inches by 96 inches. The fitted top sheet is formed by making two cut-outs in each side of the blank and then sewing these cut-outs along the cut edges. Thus, blank 30 of FIG. 4 includes a top edge 31, two side edges 33, 33' and a bottom edge 35. A first cut-out 34, 34' is made at the junction of each side edge and the bottom edge 35. Cut-out 34 has a total length along the bottom and side edges of approximately 18 inches. It includes straight cut edge portions 44, which intersect the respective edges at an angle slightly less than 45°. V-shaped cut-out portions 42 are provided which have an opening approximately 7 inches long between the intersections with cut edges 44 and which are tapered to a sharp point 40, which is spaced approximately 12 inches from the bottom and side edges. When the symmetrical cut edges of cut-out 34 are joined in a seam, they form the fitted corner of the sheet shown in FIGS. 1 through 3.

Figure 5:
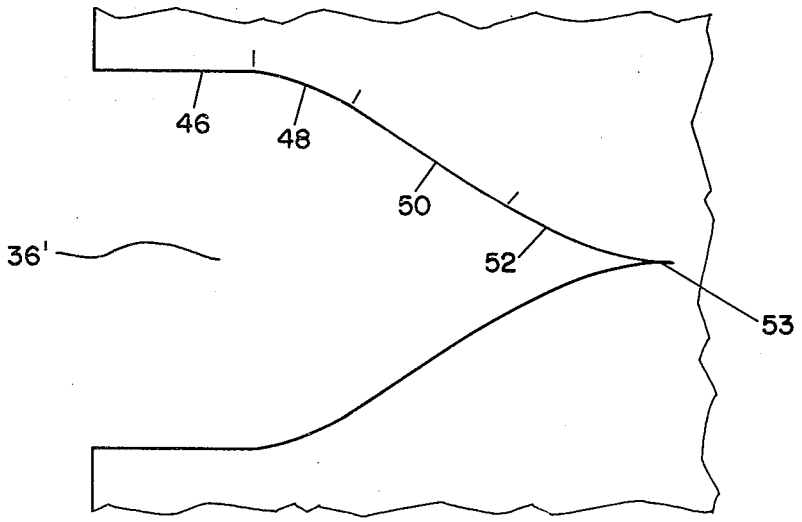
FIG. 5 is a detailed view of the side cut outs of the FIG. 4 material piece.

The foot accompanying space of the fitted top sheet is formed by second side edge cut-outs 36 and 36'. These are arranged symmetrically, and cut-out 36' is shown in greater detail in FIG. 5. The outermost portion of the cut-out comprises edges 46 which are perpendicular to the side edge and extend approximately 4 inches from the side edge. The width of the cut-out at the side edge is approximately 8 inches. Cut-out 36' has a curved edge portion 48 which connects edge 46 with tapered edge portion 50. Finally, the edge tapers to a sharp point 53 at edge portion 52. The point 53 is spaced approximately 15½ inches from the side edge 33' and 29 inches from bottom edge 35. Cut-outs 36 and 36' are symmetrical, and when the cut edges are sewn together they form tuck seam 26 which provides the foot accommodating space 28 of sheet 10.

After sewing the free edges of the two cut-outs on each side, the fitted top sheet may be bound, for example, by forming a conventional hem of the same material from which the blank 30 is made.

In order to provide a continuous peripheral seam, the junction of top edge 31 with side edges 33, 33' may be rounded as shown at 38 and 38' in FIG. 4. A 5 inch radius is suitable for this purpose.

The fitted top sheet of the present invention may be formed of any conventional sheet fabric, woven or knitted. If knitted fabric is used, for example, of the type used in constructing the fitted bottom sheet described in my prior U.S. Pat. No. 3,789,441, special advantages are realized. The use of knitted fabric, particularly two-way stretch cotton, polyester, or a blend, provides a sheet which can easily be fitted onto a large range of mattress sizes, and which will closely and neatly adhere to the mattress without need for elastic edges or straps. One sheet by reason of the width contraction in the fabric after washing and drying and the tension created by two-way stretch of the fabric can be made to accommodate the mattresses in universal use in hospitals and other health care institutions such as the 32 inches to 33 inch mattresses in use in Intensive care unit, concentrated care units, recovery sections as well as the standard 36 inch wide mattress in general hospital use and the 39 inch mattress to be found in nursing homes, homes for the aging, homes for the cronically ill and in the psychiatric section of hospitals. In addition, the one sheet will fit home mattresses measuring 32 to 36 inches width commonly called single mattresses, and the standard twin mattress measuring 39 inches in width.

The use of knitted fabric also eliminates the need for ironing, which is an important consideration when the sheet is used in hospitals. The fitted construction of the sheet saves time in making beds and makes it less likely that a bed will come undone and require remaking.

Another advantage of the stretch fabric sheet is that it has 43% less weight than conventional sheets and therefore reduces laundry loads, particularly in hospital usage.

While the invention has been described with particular reference to top sheets, those skilled in the art will recognize that it is equally applicable to blankets, bedspreads and other bedcovers.

While there has been described what are believed to be the preferred embodiments of the invention, those skilled in the art will recognize that other and further modifications may be made thereto without departing from the spirit of the present invention, and it is intended to claim all such modifications as fall within the true scope of the invention.

I claim:

1. A fitted bedcover formed from a generally rectangular piece of material having a top edge, a bottom edge and two side edges, said bedcover having two fitted bottom corners, each formed by a first cut-out of said rectangular piece at the junction of one of said side edges and said bottom edge, each of said first cut-outs being joined along its cut edge to form one of said fitted corners, said bedcover having foot accommodating space when placed on a matress, said space having maximum matress to cover height spaced at a distance from the bottom edge of said matress, said space being formed by at least two tucks, one adjoining each of said material piece side edges, each of said tucks being formed by joining opposite edges of a second, generally triangular, cut-out in each side edge of said piece.

2. A fitted bedcover as specified in claim 1 wherein said second cut-out comprises a symmetrical cut-out with a tapered width.

3. A fitted bedcover as specified in claim 2 wherein said second cut-out has a pair of first cut edge portions extending perpendicular to and intersecting said side edge and a pair of second cut edge portions connected to said perpendicular edge portions, said second edge portions being tapered toward each other and joining each other at a point.

4. A bedcover as specified in claim 1, 2 or 3 wherein said first cut-outs are each symmetrical with respect to a side edge and said bottom edge and include a pair of substantially straight cut edge portions intersecting said side and bottom edges and a generally V-shaped cut-out portion tapered to a point.

5. A bedcover as specified in claim 1 wherein said second cut-outs are spaced along said side edges from said first cut-outs.

6. A bedcover as specified in claim 1 wherein said material comprises a stretchable fabric.

7. A bedcover as specified in claim 6 wherein said fabric is a two-way stretch knitted fabric.

8. A bedcover as specified in claim 1, 6 or 7 wherein there is provided an edge binding around the periphery of said bedcover.

9. A bedcover as specified in claim 8 wherein said material piece is rounded at the corners of said side edges and said top edge and said binding extends continuously around said rounded corners.

* * * * *